United States Patent [19]

Ponchaud

[11] Patent Number: 4,731,764

[45] Date of Patent: Mar. 15, 1988

[54] SONAR TRANSDUCERS

[75] Inventor: Kenneth J. Ponchaud, Weymouth, United Kingdom

[73] Assignee: British Aerospace plc, London, England

[21] Appl. No.: 906,449

[22] Filed: Sep. 12, 1986

[30] Foreign Application Priority Data

Sep. 12, 1985 [GB] United Kingdom ..... 8522652

[51] Int. Cl.[4] ..... H04R 17/00; H04R 31/00

[52] U.S. Cl. ..... 367/158; 367/157; 310/325; 310/337; 29/594

[58] Field of Search ..... 29/25, 35, 594, 595, 29/602 A; 181/123; 310/15, 325, 337, 369; 367/140, 141, 142, 155, 156, 157, 158, 159, 160, 161, 162, 165, 167, 168, 172, 173, 174, 180

[56] References Cited

U.S. PATENT DOCUMENTS

| | | | |
|---|---|---|---|
| 2,849,628 | 8/1958 | Hollman | 367/157 X |
| 3,237,152 | 2/1966 | Cox | 367/157 X |
| 3,274,537 | 9/1966 | Toulis | 367/155 |
| 3,277,433 | 10/1966 | Toulis | 367/155 |
| 3,718,897 | 2/1973 | Abbott | 367/157 |
| 4,384,351 | 5/1983 | Pagliarini, Jr. et al. | 367/175 |
| 4,409,681 | 10/1983 | White | 367/166 |
| 4,420,826 | 12/1983 | Marshall, Jr. et al. | 367/167 |
| 4,462,093 | 7/1984 | Upton | 367/165 |
| 4,506,221 | 3/1985 | Hayner | 324/256 |

FOREIGN PATENT DOCUMENTS

| | | | |
|---|---|---|---|
| 1061447 | 8/1979 | Canada | 367/158 X |

*Primary Examiner*—Deborah L. Kyle
*Assistant Examiner*—Brian S. Steinberger
*Attorney, Agent, or Firm*—Cushman, Darby & Cushman

[57] ABSTRACT

A flextensional sonar transducer may comprise an elliptical shell which, during manufacture of the transducer, has been distorted to permit insertion of stacks of piezoelectric ceramic plates and then released to grip the stacks and maintain them in compression, even when at design depth. The distortion requires substantial loading and may damage the shell. Herein, the undistorted shell is fitted with the ceramic plate stacks and an adjustable wedge device which is settable to provide the required pre-load. The wedge device may be coupled to an actuator, pressure sensor combination which automatically maintains a desired pre-load for different depths.

6 Claims, 4 Drawing Figures

Fig. 1.
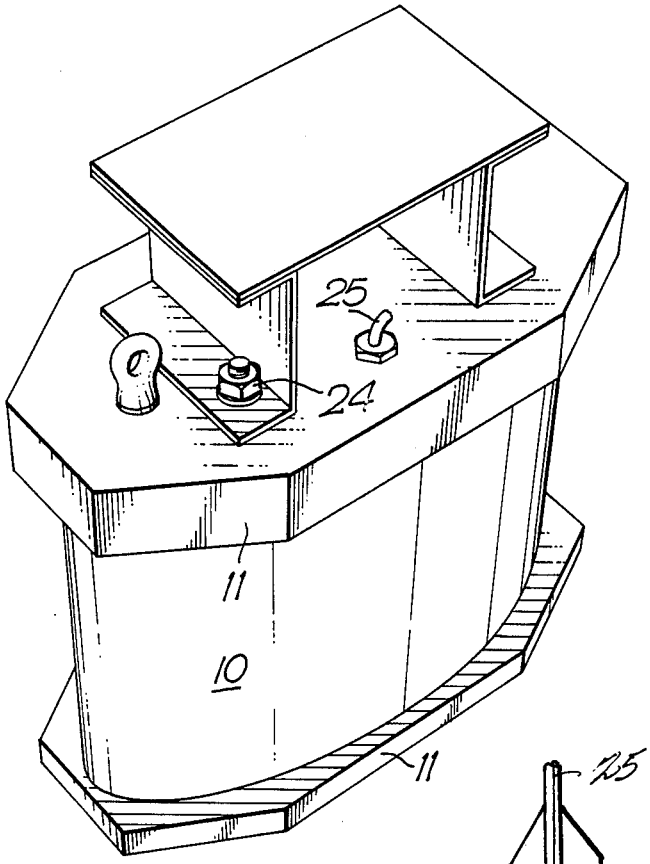
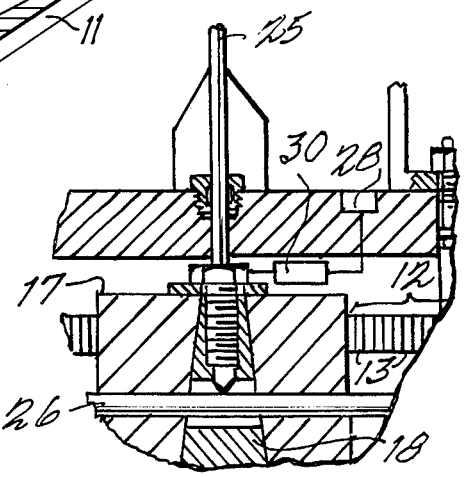
Fig 4

SONAR TRANSDUCERS

This invention relates to flextensional sonar transducers. Various forms of flextensional transducer are described in U.S. Pat. Nos. 3,274,537 and 3,277,433. Such transducers are used as an acoustic energy source for underwater sonar use to radiate high power acoustic energy at low frequencies. A typical flextensional transducer cmprises a thick-walled aluminum or glass-reinforced plastics (GRP) shell of elliptical cylinder form and an internal stack ofpiezo electric ceramic plates extending along the major axis of the shell. The stack of piezo electric ceramic plates is driven electrically to vibrate axially and can only provide a small linear displacement along the major axis but the elliptical shape causes a magnified deflection along the minor axis and the net volume displacement can generate high acoustic power. The operational frequency ranges extend from roughly 500 Hz to 3 kHz for aluminum or from 300 Hz to 2 kHz for GRP shells.

In a conventional method of assembly the elliptical shell is compressed along its minor axis effectively to lengthen the major axis; the internal stacks of piezo electric ceramic cells are inserted into the shell and the compressive load removed from the minor axis to that the major axis contracts to grip the stacks with sufficient preload to prevent a tensile load being applied to the stacks when the transducer is operating at its design depth. It will be understood that it is necessary to compress the shell to an extent which allows sufficient clearance for the stacks of piezo electric ceramic plates to be slid into place an bonded. This method of assembly is disadvantageous because a very high compressive load needs to be applied to the minor axis of the shell and this requires the use of a powerful press. In addition, it is necessary to over compress the shell to allow for sufficient clearance and in practice this may cause the thick-walled elliptical shell to fail.

In designing a flextensional transducer it is necessary to ensure that the stacks of piezo electric ceramic plates are maintained under compression even when the transducer is subject to high hydrostatic pressures, otherwise the plate and the performance of the device may degrade. Thus the deeper a flextensional transducer is intended to operate so the degree of preload compresison required during assembly increases. However the higher the preload compression for the ceramic cells the greater is the compression of the elliptic shell required during assembly and there is also a limit on the compressive load which may be applied to the plates without inducing a non-linear response.

According to one aspect of this invention, there is provided a sonar transducer assembly comprising a hollow shell element of generally elliptical cylinder form, drive means located within said shell engaging opposed walls thereof for exciting said shell element, and wedge means for exerting a preload on said drive means.

By this arrangement it is not necessary to over compress the shell element during assembly to allow insertion of the drive means; instead the drive means may be inserted and the wedge means then operated to impart the required preload without a requirement for any externally applied load.

Preferably said drive means comprises twin sets of drive elements located one to each side of said wedge assembly.

In one arrangement said wedge means is locked during assembly to provide a single predetermined preload. As an alternative however, the transducer may include actuator means for adjusting said wedge means in response to signals received from a pressure sensor. In this way the degree of preload may adjust automatically to suit the depth at which the transducer is operating.

In another aspect of this invention, there is provided a method of assembling a sonar transducer, which includes the steps of (i) selecting a hollow shell element of generally elliptical cylinder form, (ii) inserting between opposed walls of said shell element a drive arrangement including drive means for exciting said shell element and wedge means, and (iii) operating said wedge means to preload said drive means to a predetermined degree.

By way of example only, one specific embodiemnt of flextensional sonar transducer will now be described, reference being made to the accompanying drawings in which:

FIG. 1 is a perspective view of a flextensional transducer;

FIG. 4 is a fragmentary view corresponding to FIG. 2 showing a modification.

Figure 2:
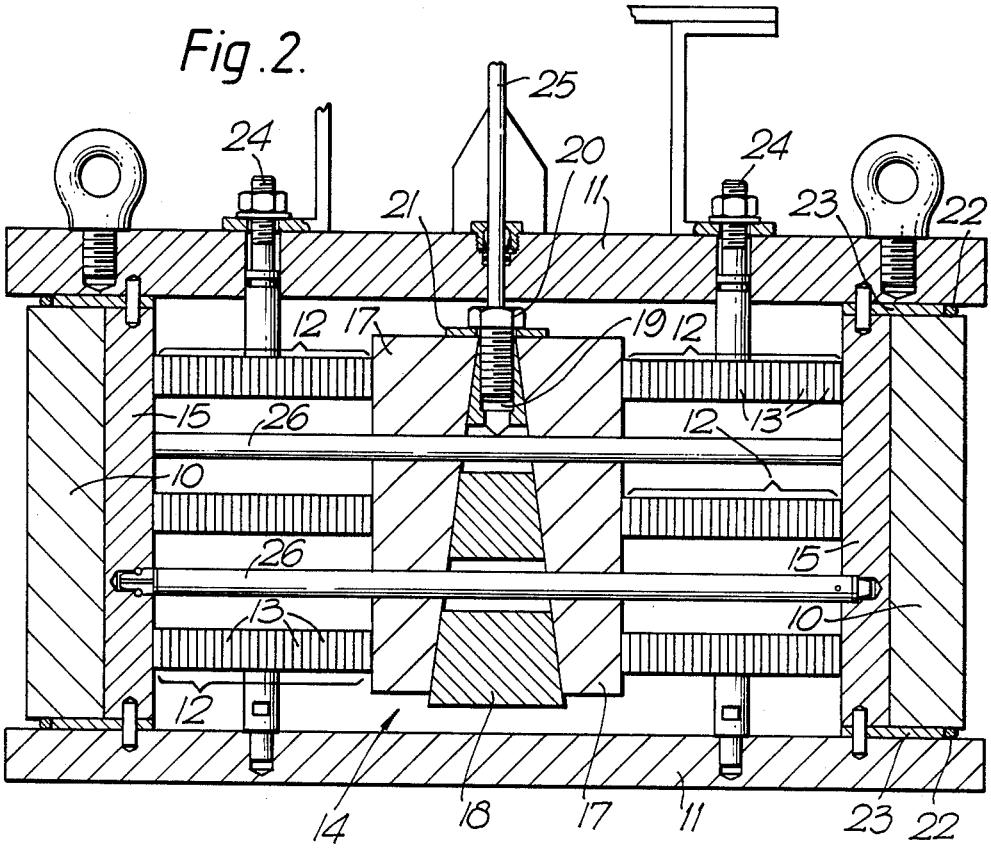
FIG. 2 is a vertical section view of the flextensional transducer of FIG. 1.
Figure 3:
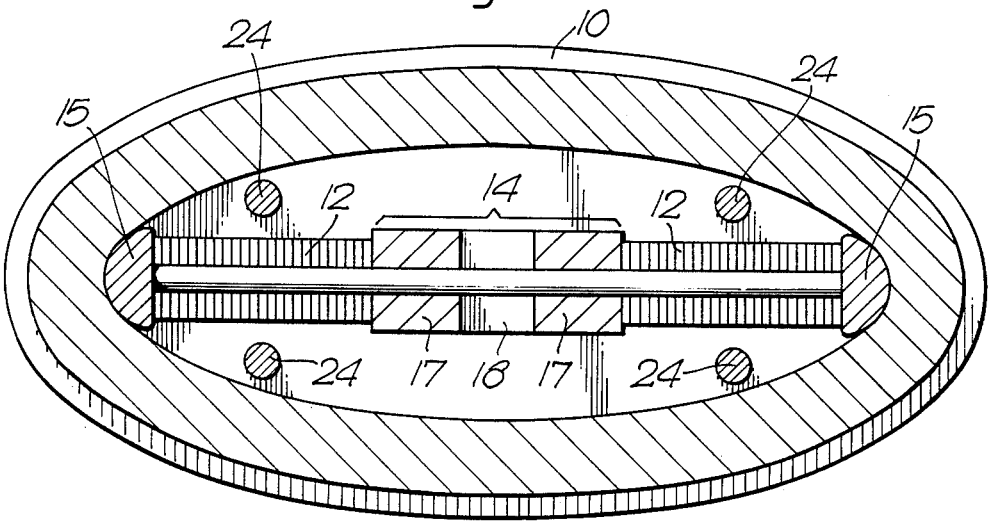
FIG. 3 is a horizontal section view of the flextensional transducer of FIG. 1.

The drawings, show a flextensional transducer for use underwater for emitting high power, low frequency acoustic energy.

The transducer comprises a thick-walled elliptical cylindrical shell 10 of aluminium material sealingly and slidably supported between two end plates 11. A drive arrangement extends along the major axial plane of the shell 10 and comprises six stacks 12 of piezo electric ceramic plates 13 arranged in three opposed pairs located each side of a central wedge assembly 14. The stacks 12 act on the opposed wall sections of the shell element via respective D-section bars 15. The plates may be made, for example, of lead zirconate titanate, and connected in parallel to receive an electrical energising signal. when energised the stcks vibrato axially and thus induce the shell element to vibrate at the same frequency. Instead of being made from piezo electric material, the stacks may be formed of magnetostrictive material.

The central wedge assembly comprises two outer wedge portions 17 each connected to one end of the respective drive stacks 12 and an inner tapered portion 18. The thin end of the tapered portion 18 includes a threaded bore 19 in which is engaged a bolt 20 which, together with washer 21, maintains the outer wedge portions 17 and the tapered portion 18 in predetermined relative positions and thus maintains the transducer as a whole at a predeterined compressive load. A seal ring 22 and a spacer plate 23 are slidably located between each end face of the shell 10 and the associated end plate 11 whilst preventing ingress of fluid. The end plates 11 are held in to allow the shell to vibrate freely with respect to the end plates place by means of four tensile bolts 24 passing therebetween.

In use the transducer is lowered to the required depth and a driving signal at the required frequency is supplied to the drive elements via cable 25, to cause vibration of the shell element.

In order to assemble the above described embodiment, the drive stacks 12 and bars 15 together with the wedge assembly 14 are located loosely in position within the shell 10 and a compressive load is applied to the wedge assembly 14 to cause it to expand and this exert a compressive load on the drive stacks 12 to be preloaded. The amount of preload is measured by measruing the expansion of the elliptical shell as the wedge is operated. The wedge assembly is then locked in this condition by means of bolt 20 and the end plates 11 are secured in place. It will be appreciated that the compressive load required to be applied to the wedge assembly to achieve a given degree of compression (typically 8 tons) is much smaller than that required to be applied to the shell element in the conventional assembly method described in the introduction (typically 20 tons). In order to facilitate initial assembly of the device, twin spaced connecting rods 26 connect the two D-section bars 15 but allow sufficient relative movement thereof to allow the drive means to operate. The rods 26 pass through bores in the outer wedge portions 17 and an oversized bore in the tapered portion which is large enough toallow the required amount of relative movement of the tapered portion.

In another embodiment a pressure sensor 28 is provided to sense the magnitude of the hydrostatic pressure acting on the shell element and bolt 20 is replaced, or actuated as shown diagrammatically in FIG. 4 by a hydraulic controlled by signals from the sensor ram 30 to effect movement of the tapered portion 18 relative to the two outer wedge portions 17 to allow continuous adjustment of the degree of preload. The amount of preload applied is controlled in dependence upon the magnitude of the hydrostatic pressure so as to apply a preload to the stacks appropriate for the particular depth (and pressure) at which the transducer is operating.

Whilst the embodiment described and illustrated includes but a single shell assembly located between two end plates, the flat ended design of the shell 10 enables several elements to be joined together in a long continuous stave to control beam pattern and power.

What is claimed is:

1. Sonar transducer assembly for submerged operation in water comprising:

a hollow water-tight shell of generally elliptical cylinder form;

drive means located within said shell for engaging opposed portions thereof at the ends of the major axis of the ellipse so as, in use, to excite said shell, said drive means being held in compression and said shell being configured so that, in use, exterior water pressure tends to reduce the compressive force on said drive means; and wedge means interposed in said drive means for exerting a compressive preload thereon.

2. An assembly according to claim 1 wherein a part of the wedge means is movable along the major cylindrical axis of the shell so as to adjust the compressive force applied to the drive means.

3. An assembly according to claim 1, including water pressure sensor means, and actuator means connected to said pressure sensor means and to said wedge means and operable to adjust said wedge means in response to signals from said pressure sensor means.

4. An assembly according to claim 1, wherein said drive means comprises two sets of drive elements located one to each side of said wedge means.

5. An assembly according to claim 4 wherein the wedge means comprises an inner tapered member sandwiched between two outer complementary tapered members.

6. A method of assembling a sonar transducer, which includes the steps of (i) providing a hollow shell of generally elliptical cylinder form, (ii) inserting between opposed portions of said shell at the ends of the major axes of the ellipse a drive arrangement including drive means for exciting said shell and wedge means interposed in said drive means for exerting a compressive preload thereon, and (iii) adjusting said wedge means to compressively preload said drive means to a predetermined degree.

* * * * *